US006168574B1

(12) United States Patent
VanDemark

(10) Patent No.: US 6,168,574 B1
(45) Date of Patent: Jan. 2, 2001

(54) MASSAGE WAND WITH CONNECTING FITTING FOR SPA JET OUTLET

(76) Inventor: Ted S. VanDemark, 9925 S. W. 218 Ter., Miami, FL (US) 33190

( * ) Notice: Under 35 U.S.C. 154(b), the term of this patent shall be extended for 0 days.

(21) Appl. No.: 09/283,880

(22) Filed: Apr. 1, 1999

(51) Int. Cl.[7] ..... A61H 33/00

(52) U.S. Cl. ..... 601/155; 601/160; 601/169; 285/317; 285/319

(58) Field of Search ..... 601/154, 155, 601/159–169; 4/568, 570; 285/317, 319, 7

(56) References Cited

U.S. PATENT DOCUMENTS

| | | | | |
|---|---|---|---|---|
| 856,401 | * | 6/1907 | Hannold | 285/317 |
| 890,790 | | 6/1908 | Richwood . | |
| 1,948,167 | | 2/1934 | Cornwell . | |
| 2,523,770 | * | 9/1950 | Marette | 285/7 |
| 2,703,081 | | 3/1955 | Haines . | |
| 3,771,186 | * | 11/1973 | Moret et al. | 601/160 X |
| 4,313,432 | | 2/1982 | Sievers . | |
| 4,458,676 | * | 7/1984 | Pileggi | 601/105 |
| 4,603,688 | | 8/1986 | Roming . | |
| 5,054,474 | * | 10/1991 | Jacob et al. | 601/160 |
| 5,187,827 | | 2/1993 | Wei | 15/22.1 |
| 5,197,459 | * | 3/1993 | Henkin et al. | 301/160 |
| 5,385,532 | * | 1/1995 | Shyu | 601/160 |

* cited by examiner

*Primary Examiner*—Danton D. DeMille
(74) *Attorney, Agent, or Firm*—Joseph N. Breaux

(57) ABSTRACT

A spa accessory that includes a massage wand, a connecting fitting, and a flexible connecting hose connected between the massage wand and the connecting fitting. The connecting fitting is adapted to connect the accessory to tubular spa jet outlet tubes that are not adapted to attach with an accessory.

1 Claim, 3 Drawing Sheets

MASSAGE WAND WITH CONNECTING FITTING FOR SPA JET OUTLET

TECHNICAL FIELD

The present invention relates to spa accessories and more particularly to a massage wand with connector fitting for a spa jet outlet that includes a massage wand, a connecting fitting, and a flexible connecting hose connected between the massage wand and the connecting fitting; the massage wand including a number of rotating jet heads, a number of rotating massage heads, a water pressure adjustment valve, and a gripping handle; the connecting fitting including an elongated tubular body having a pair of opposed flexible locking members formed in connection therewith; the elongated tubular body being in connection with the flexible hose at a first end thereof and having a pair of opposed slots formed therein in connection with a second end thereof; each of the flexible locking members including a raised center portion centered on a sealing structure to form two sealing ledges within the elongated tubular body that each extend past a side edge of the center portion; each sealing structure having a width greater than the width of a slot; each flexible locking member having a locking edge at the end thereof; the locking edge of each flexible locking member extending radially outward past the outer surface of the elongated tubular body sufficiently to prevent removal of the second end of the elongated tubular body when it has been inserted entirely through a tubular spa jet outlet tube and the flexible locking members are unflexed; the two flexible locking members each having a compression button extending outwardly above the outer surface of the elongated tubular body to facilitate compressing of the two flexible locking members to allow for inserting into the outlet opening of a tubular spa jet outlet tube.

BACKGROUND ART

It is often desirable when relaxing in a spa having a number of jet outlets to direct the flow of water from one of the jet outlets onto a particular portion of the body. Although directing the water onto a leg or other lower body part is not difficult, it is virtually impossible to direct the massaging water from the jet output onto the neck and/or shoulders. It would be desirable, therefore, to have a spa accessory that was connectable to a tubular spa jet outlet tube that included an elongated flexible hose with a massaging wand at the end to allow the user to massage and direct a massaging spray onto a desired body part such as the neck or shoulders. Because tubular spa jet outlet tubes are typically not threaded or otherwise adapted for connecting an accessory thereto, it would be a further benefit if the spa accessory included a connecting fitting suitable for connection with a tubular spa jet outlet tube.

GENERAL SUMMARY DISCUSSION OF INVENTION

It is thus an object of the invention to provide a massage wand with connector fitting for spa jet outlets.

It is a further object of the invention to provide a massage wand with connector fitting for spa jet outlet that includes a massage wand, a connecting fitting, and a flexible connecting hose connected between the massage wand and the connecting fitting; the massage wand including a number of rotating jet heads, a number of rotating massage heads, a water pressure adjustment valve, and a gripping handle; the connecting fitting including an elongated tubular body having a pair of opposed flexible locking members formed in connection therewith; the elongated tubular body being in connection with the flexible hose at a first end thereof and having a pair of opposed slots formed therein in connection with a second end thereof; each of the flexible locking members including a raised center portion centered on a sealing structure to form two sealing ledges within the elongated tubular body that each extend past a side edge of the center portion; each sealing structure having a width greater than the width of a slot; each flexible locking member having a locking edge at the end thereof; the locking edge of each flexible locking member extending radially outward past the outer surface of the elongated tubular body sufficiently to prevent removal of the second end of the elongated tubular body when it has been inserted entirely through a tubular spa jet outlet tube and the flexible locking members are unflexed; the two flexible locking members each having a compression button extending outwardly above the outer surface of the elongated tubular body to facilitate compressing of the two flexible locking members to allow for inserting into the outlet opening of a tubular spa jet outlet tube.

Accordingly, a massage wand with connector fitting for spa jet outlet is provided. The massage wand with connector fitting for spa jet outlet includes a massage wand, a connecting fitting, and a flexible connecting hose connected between the massage wand and the connecting fitting; the massage wand including a number of rotating jet heads, a number of rotating massage heads, a water pressure adjustment valve, and a gripping handle; the connecting fitting including an elongated tubular body having a pair of opposed flexible locking members formed in connection therewith; the elongated tubular body being in connection with the flexible hose at a first end thereof and having a pair of opposed slots formed therein in connection with a second end thereof; each of the flexible locking members including a raised center portion centered on a sealing structure to form two sealing ledges within the elongated tubular body that each extend past a side edge of the center portion; each sealing structure having a width greater than the width of a slot; each flexible locking member having a locking edge at the end thereof; the locking edge of each flexible locking member extending radially outward past the outer surface of the elongated tubular body sufficiently to prevent removal of the second end of the elongated tubular body when it has been inserted entirely through a tubular spa jet outlet tube and the flexible locking members are unflexed; the two flexible locking members each having a compression button extending outwardly above the outer surface of the elongated tubular body to facilitate compressing of the two flexible locking members to allow for inserting into the outlet opening of a tubular spa jet outlet tube.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
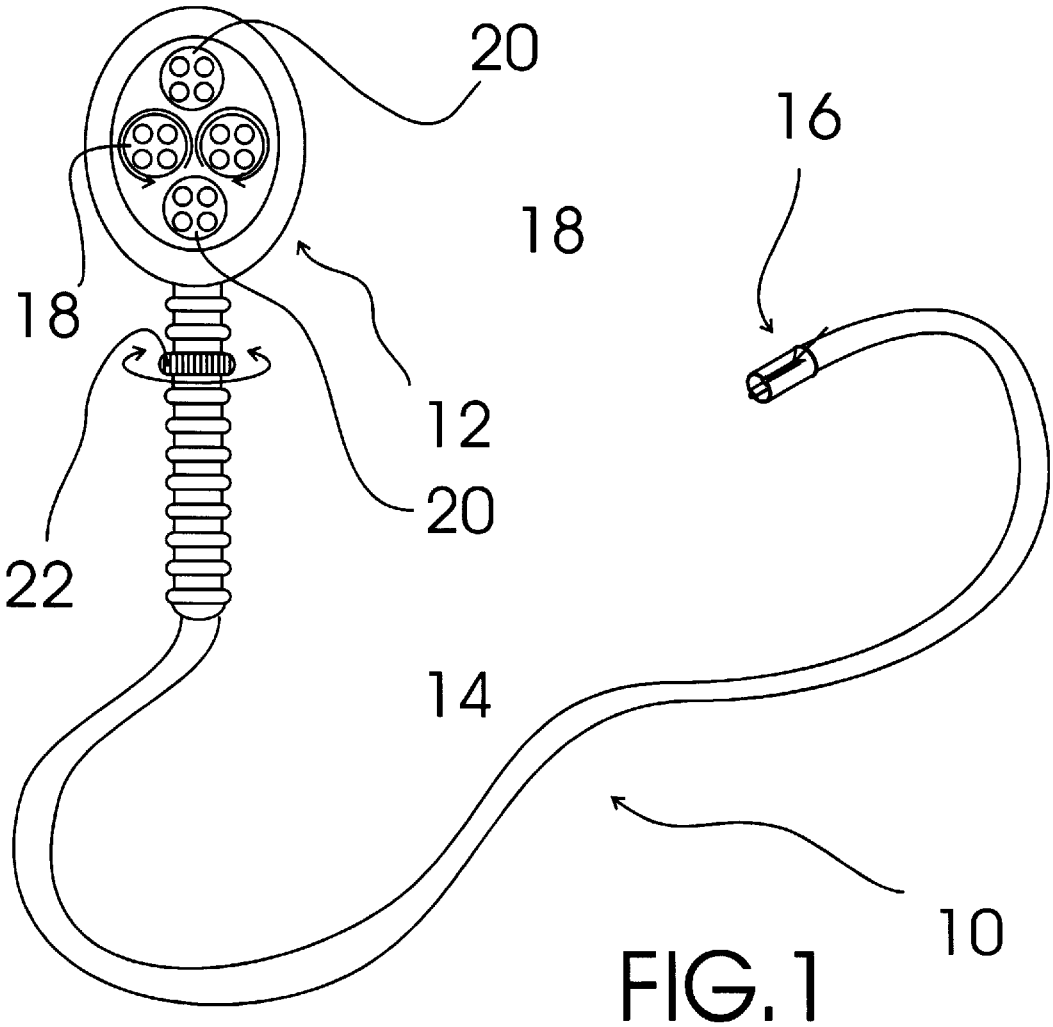
FIG. 1 is a perspective view of an exemplary embodiment of the massage wand with connector fitting for spa jet outlet of the present invention showing the massage wand, the flexible connecting hose, and the connecting fitting; the massage wand including a number of rotating jet heads, a number of rotating massage heads, a water pressure adjustment valve, and a gripping handle; the connecting fitting including an elongated tubular body having a pair of opposed flexible locking members formed in connection therewith; the elongated tubular body being in connection with the flexible hose at a first end thereof and having a pair of opposed slots formed therein in connection with a second end thereof; each of the flexible locking members including a raised center portion centered on a sealing structure to form two sealing ledges within the elongated tubular body that each extend past a side edge of the center portion; each sealing structure having a width greater than the width of a slot; each flexible locking member having a locking edge at the end thereof; the locking edge of each flexible locking member extending radially outward past the outer surface of the elongated tubular body sufficiently to prevent removal of the second end of the elongated tubular body when it has been inserted entirely through a tubular spa jet outlet tube and the flexible locking members are unflexed; the two flexible locking members each having a compression button extending outwardly above the outer surface of the elongated tubular body to facilitate compressing of the two flexible locking members to allow for inserting into the outlet opening of a tubular spa jet outlet tube.

FIG. 1 is a perspective view of an exemplary embodiment of the massage wand with connector fitting for spa jet outlet of the present invention generally designated 10. Massage wand with connector fitting 10 includes a massage wand, generally designated 12; a flexible connecting hose, generally designated 14; and a connecting fitting, generally designated 16. Flexible connecting hose 14 is connected between massaging wand 12 and connecting fitting 16. Massage wand 12 includes two rotating jet spray heads 18, two rotating massage heads 20, a water pressure adjustment valve 22, and a gripping handle 24.

Figure 2:
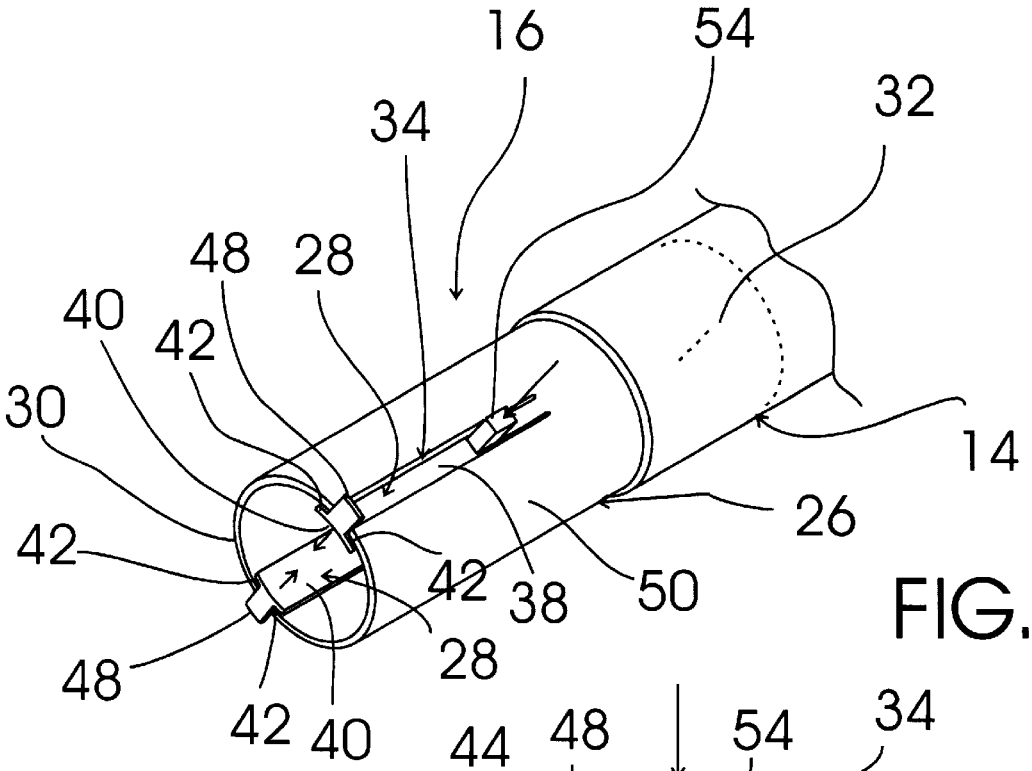
FIG. 2 is a detail perspective view of the connecting fitting attached to an end of the flexible connecting hose.
Figure 3:
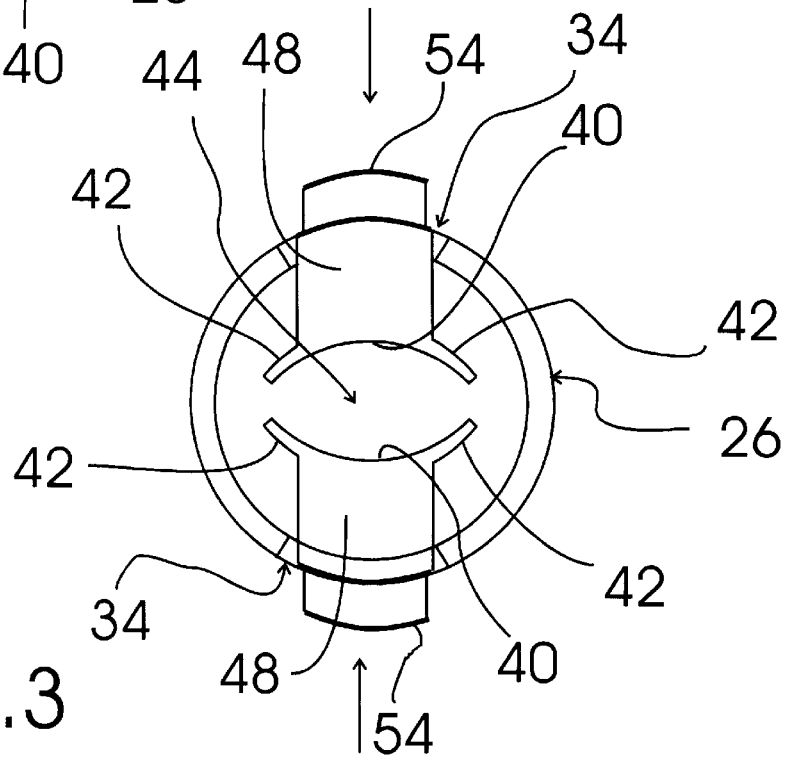
FIG. 3 is an end view of the connecting fitting showing the flexible locking members compressed such that the locking edges are positioned level with the outer surface of the elongated tubular body.

Referring now to FIG. 2, connecting fitting 16 includes an elongated tubular body, generally designated 26, having a pair of opposed flexible locking members, generally designated 28, formed in connection therewith. Elongated tubular body 26 has an outer diameter selected to allow insertion thereof into a tubular spa jet outlet tube and a length sufficient to allow insertion of a second end 30 thereof past the interior end of the tubular spa jet outlet tube. The first end 32 of elongated tubular body 26 is secured in connection with flexible connecting hose 14. Elongated tubular body 26 has a pair of opposed slots 34 (see also FIG. 3) formed therein in connection with second end 30. Each of the flexible locking members 28 includes a raised center portion 38 running the length of slot 34 and, referring now to FIG. 3, centered on a sealing structure 40 to form two sealing ledges 42 within the passageway 44 of elongated tubular body 26. Each sealing structure 40 has a width greater than the width of a slot 34.

Referring back to FIG. 2, each flexible locking member 28 has a locking edge 48 at the end thereof. The locking edge 48 of each flexible locking member 28 extends radially outward past the outer surface 50 of elongated tubular body 26 about one-third inch (⅓"). Each of the two flexible locking members 28 has a compression button 54 extending outwardly above outer surface 50 of elongated tubular body 26 to facilitate compressing of the two flexible locking members 28.

Figure 4:
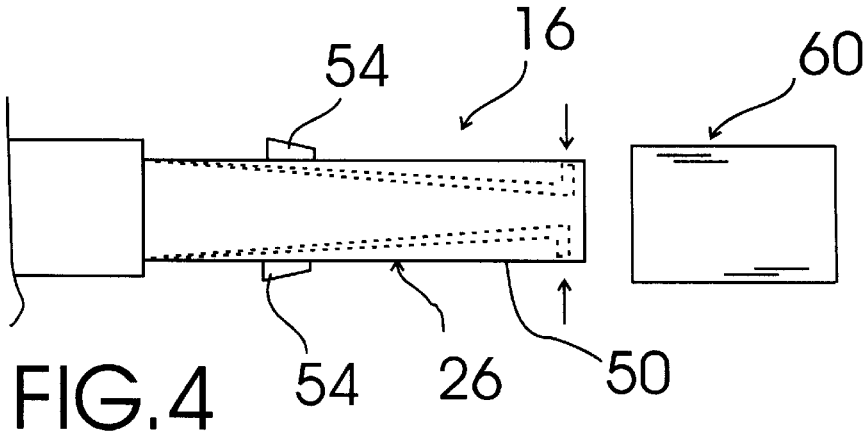
FIG. 4 is a side plan view showing the connecting fitting with the flexible locking members compressed such that the locking edges are positioned level with or below the outer surface of the elongated tubular body and positioned in front of the outlet opening of a representative a tubular spa jet outlet tube.
Figure 5:
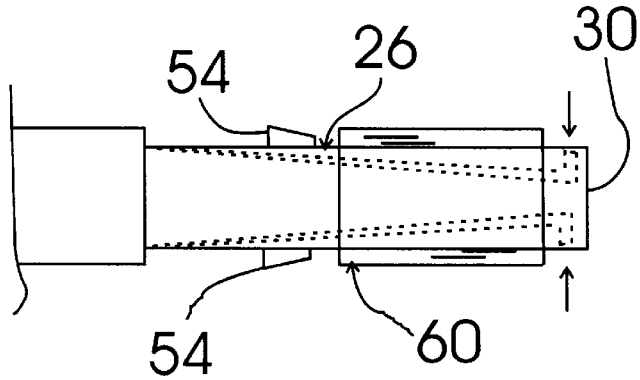
FIG. 5 is a side plan view showing the connecting fitting with flexible locking members compressed such that the locking edges are positioned level with or below the outer surface of the elongated tubular body and with the second end positioned entirely through the representative tubular spa jet outlet tube.
Figure 6:
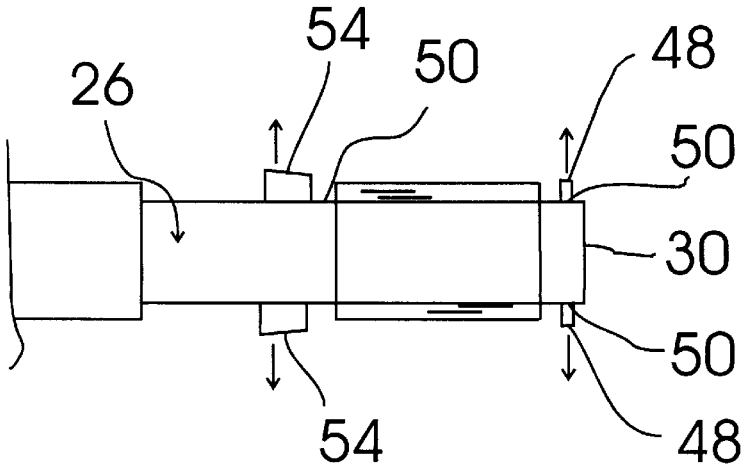
FIG. 6 is a side plan view showing the second end of elongated tubular body of the connecting fitting positioned entirely through the representative tubular spa jet outlet tube and the flexible locking members unflexed with the locking edges of each flexible locking member extending radially outward past the outer surface of the elongated tubular body sufficiently to prevent removal of the second end of the elongated tubular body through the representative tubular spa jet outlet tube.

With reference to FIG. 4, connecting fitting 16 is connected to a tubular spa jet outlet tube 60 by pressing the compression buttons 54 together such that the locking edges 48 (FIGS. 2 and 3) are positioned level with or below the outer surface 50 of elongated tubular body 26. Referring now to FIG. 5, second end 30 of elongated tubular body 26 is then inserted entirely through tubular spa jet outlet tube 60 while continuing to compress compression buttons 54. Compression buttons 54 are then released, allowing flexible locking members 28 (FIG. 2) to resume their normal position with the locking edge 48 of each flexible locking member extending radially outward past the outer surface 50 of elongated tubular body 26 sufficiently to prevent removal of second end 30 of the elongated tubular body 26 through the representative tubular spa jet outlet tube 60.

It can be seen from the preceding description that a massage wand with connector fitting for spa jet outlet has been provided that includes a massage wand, a connecting fitting, and a flexible connecting hose connected between the massage wand and the connecting fitting; the massage wand including a number of rotating jet heads, a number of rotating massage heads, a water pressure adjustment valve, and a gripping handle; the connecting fitting including an elongated tubular body having a pair of opposed flexible locking members formed in connection therewith; the elongated tubular body being in connection with the flexible hose at a first end thereof and having a pair of opposed slots formed therein in connection with a second end thereof; each of the flexible locking members including a raised center portion centered on a sealing structure to form two sealing ledges within the elongated tubular body that each extend past a side edge of the center portion; each sealing structure having a width greater than the width of a slot; each flexible locking member having a locking edge at the end thereof; the locking edge of each flexible locking member extending radially outward past the outer surface of the elongated tubular body sufficiently to prevent removal of the second end of the elongated tubular body when it has been inserted entirely through a tubular spa jet outlet tube and the flexible locking members are unflexed; the two flexible locking members each having a compression button extending outwardly above the outer surface of the elongated tubular body to facilitate compressing of the two flexible locking members to allow for inserting into the outlet opening of a tubular spa jet outlet tube.

It is noted that the embodiment of the massage wand with connector fitting for spa jet outlet described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A massage wand with connector fitting for spa jet outlet comprising:

a massage wand;

a connecting fitting; and a flexible connecting hose connected between said massage wand and said connecting fitting;

said massage wand including a number of rotating jet heads, a number of rotating massage heads, a water pressure adjustment valve, and a gripping handle;

said connecting fitting including an elongated tubular body having a pair of opposed flexible locking members formed in connection therewith;

said elongated tubular body being in connection with said flexible hose at a first end thereof and having a pair of opposed slots formed therein in connection with a second end thereof;

each of said flexible locking members including a raised center portion centered on a sealing structure to form two sealing ledges within said elongated tubular body that each extend past a side edge of said center portion;

each sealing structure having a width greater than said width of a slot; each flexible locking member having a locking edge at said end thereof;

said locking edge of each flexible locking member extending radially outward past said outer surface of said elongated tubular body sufficiently to prevent removal of said second end of said elongated tubular body when it has been inserted entirely through a tubular spa jet outlet tube and said flexible locking members are unflexed;

said two flexible locking members each having a compression button extending outwardly above said outer surface of said elongated tubular body to facilitate compressing of said two flexible locking members to allow for inserting into said outlet opening of a tubular spa jet outlet tube.

* * * * *